US005440375A

United States Patent [19]

Fujisawa et al.

[11] Patent Number: 5,440,375

[45] Date of Patent: Aug. 8, 1995

[54] CORONA DISCHARGER DISPLACING MECHANISM AND GRID ELECTRODE POSITIONING MECHANISM

[75] Inventors: Shuji Fujisawa; Susumu Komaki; Shingo Sakato; Masami Taniguchi; Hideki Takeda, all of Osaka, Japan

[73] Assignee: Mita Industrial Co., Ltd., Osaka, Japan

[21] Appl. No.: 179,547

[22] Filed: Jan. 10, 1994

[30] Foreign Application Priority Data

Jan. 11, 1993 [JP] Japan ..... 5-002743
Jan. 11, 1993 [JP] Japan ..... 5-002895

[51] Int. Cl.[6] ..... G03G 15/02

[52] U.S. Cl. ..... 355/221; 250/325; 250/326; 355/225

[58] Field of Search ..... 355/219, 221, 225; 250/324, 325, 326

[56] References Cited

U.S. PATENT DOCUMENTS

| | | | |
|---|---|---|---|
| 4,260,240 | 4/1981 | Pieper | 355/221 |
| 4,550,253 | 10/1985 | Hashimoto | 250/324 X |
| 4,754,305 | 6/1988 | Fantuzzo et al. | 355/221 X |
| 5,079,668 | 1/1992 | Maeshima | 250/324 X |
| 5,095,335 | 3/1992 | Watanabe et al. | 355/219 X |
| 5,335,050 | 8/1994 | Osbourne et al. | 355/221 |

*Primary Examiner*—Fred L. Braun
*Attorney, Agent, or Firm*—Beveridge, DeGrandi, Weilacher & Young

[57] ABSTRACT

The present invention relates to a corona discharger displacing mechanism and a grid electrode positioning mechanism which are used for a unit of an image forming section in an image forming apparatus. The displacing mechanism causes a corona discharger to advance or retreat in synchronism with the inserting or extracting operation of the unit. On the other hand, the positioning mechanism stretches a grid electrode in co-operation with the unit.

23 Claims, 9 Drawing Sheets

CORONA DISCHARGER DISPLACING MECHANISM AND GRID ELECTRODE POSITIONING MECHANISM

CROSS REFERENCE TO RELATED APPLICATION

This application claims priority benefits under 35 USC § 119 of Japanese Patent Application Serial Nos. 5-2895 and 5-2743, the disclosures of which are incorporated by reference.

BACKGROUND OF THE INVENTION

1. Field of the Invention

The present invention relates generally to a corona discharger displacing mechanism and a grid electrode positioning mechanism, and more particularly, to a corona discharger displacing mechanism and a grid electrode positioning mechanism which are most suitable for an image forming apparatus, such as an electrostatic process copying machine, a facsimile and a laser beam printer.

2. Description of the Related Art

An image forming apparatus employing this type of corona discharger displacing mechanism generally comprises an image forming section for developing an electrostatic latent image into a toner image.

The image forming section comprises an image carrier for carrying an image to be formed and a corona discharger having a discharge wire stretched in the vicinity of the surface of the image carrier. The corona discharger is for applying a high voltage to the discharge wire from a feed component of the image forming apparatus through a high-voltage generating component, to cause the discharge wire to induce corona discharge so that the surface of the image carrier is charged.

The image carrier must be replaced frequently depending on the state of use because its service life is relatively short. Consequently, there has widely been employed a unit detachably contained in the main body of an image forming apparatus which detachably supports the image carrier. This unit has such simple operational advantages that an image carrier on the unit can be replaced with a new one by extracting the unit from the main body of the image forming apparatus when a predetermined amount of image forming operations have been performed.

On the other hand, because the discharge wire in the corona discharger is opposed to the vicinity of the image carrier, a mechanism is required to enable the replacement of the unit. Therefore, the image forming apparatus has conventionally been provided with a displacing mechanism for displacing the corona discharger to a retreat position, where the replacement or insertion and extraction of the unit is allowed, and a set position, where the discharge wire is opposed to the vicinity of the image carrier in the unit.

In order to apply the image forming apparatus of the foregoing construction for home or personal use, it is preferable that maintenance work of the unit can be performed as simply and reliably as possible.

In the foregoing construction, however, the displacing operation of the corona discharger and the replacement operation of the unit are not synchronized with each other. Accordingly, a user must individually perform the operations. This is a great burden to the user.

In addition, the user frequently forgets to set the corona discharger.

Accordingly, what is really needed is a corona discharger displacing mechanism which can perform the maintenance work of a unit simply and reliably, thereby constituting the most suitable image forming apparatus for home or personal use.

Next, there may be employed an image forming section of a so-called scorotron type in the foregoing image forming apparatus.

The image forming section of a scorotron type comprises a grid electrode stretched in the vicinity of the surface of the image carrier so that the corona discharger charges the surface of an image carrier through the grid electrode (see, for example, Japanese Unexamined Patent Publication No. 59-56381).

The grid electrode must be constructed so as to be detachable relatively easily for cleaning or replacement. Conventionally, in the image forming apparatus of a scorotron type, the grid electrode has also been detachably mounted on a unit, similar to the image carrier.

More specifically, the image forming apparatus of scorotron type has a unit which is integrally provided with a pair of supporting portions for holding the image carrier. Supporting portions have predetermined parts to which are respectively fixed both ends of the grid electrode corresponding to the support portions. The unit is further provided with a contact portion onto which the grid electrode is pressed so as to apply a predetermined tensile force to the grid electrode in co-operation with a fixing member.

In order to improve the charging performance of the image forming apparatus of the foregoing construction, it is preferable that the opposed distance between the grid electrode and the surface of the image carrier is kept uniform.

In the conventional construction, however, there is only provided the contact portion onto which the grid electrode is pressed. Accordingly, it is difficult to adjust the grid electrode to the contact portion and to position the grid electrode on the surface of the image carrier. Therefore, assembling error often occurred in the opposed distance between the grid electrode and the image carrier, thereby being a burden to the manufacturing operator.

Accordingly, what is really needed is a grid electrode positioning mechanism capable of positioning a grid electrode on the surface of an image carrier reliably, thereby exhibiting high charging performance.

SUMMARY OF THE INVENTION

In accordance with one aspect, the present invention is directed to a corona discharger displacing mechanism that satisfies this need. The corona discharger displacing mechanism is associated with a unit, and the unit can be inserted into or extracted from an image forming apparatus. The novel construction of the present invention allows the inserting or extracting operation of the unit into or from the image forming apparatus and the displacing operation of a corona discharger to be synchronized with each other. As a result, if the unit is inserted into the image forming apparatus, the corona discharger is synchronously displaced to a set position. On the other hand, if the unit is extracted from the image forming apparatus, the set corona discharger is synchronously displaced to a retreat position. In the present invention, therefore, the setting operation of the corona discharger can be automatically performed.

Consequently, it is possible to prevent a user from forgetting to set the corona discharger which is retreated. Moreover, there is no likelihood that the corona discharger will interfere with a member on the side of the unit in the extracting operation of the unit.

In accordance with another aspect, the present invention is directed to a grid electrode positioning mechanism. The grid electrode positioning mechanism according to the present invention comprises means for stretching a grid electrode in co-operation with a unit, and the unit holds an image carrier, so that the grid electrode is reliably positioned. Consequently, the opposed distance between the grid electrode and the surface of the image carrier can be precisely set, thus exhibiting high charging performance.

The foregoing and other objects, features, aspects and advantages of the present invention will become more apparent from the following detailed description of the present invention when taken in conjunction with the accompanying drawings.

DESCRIPTION OF PREFERRED EMBODIMENTS

Figure 1:
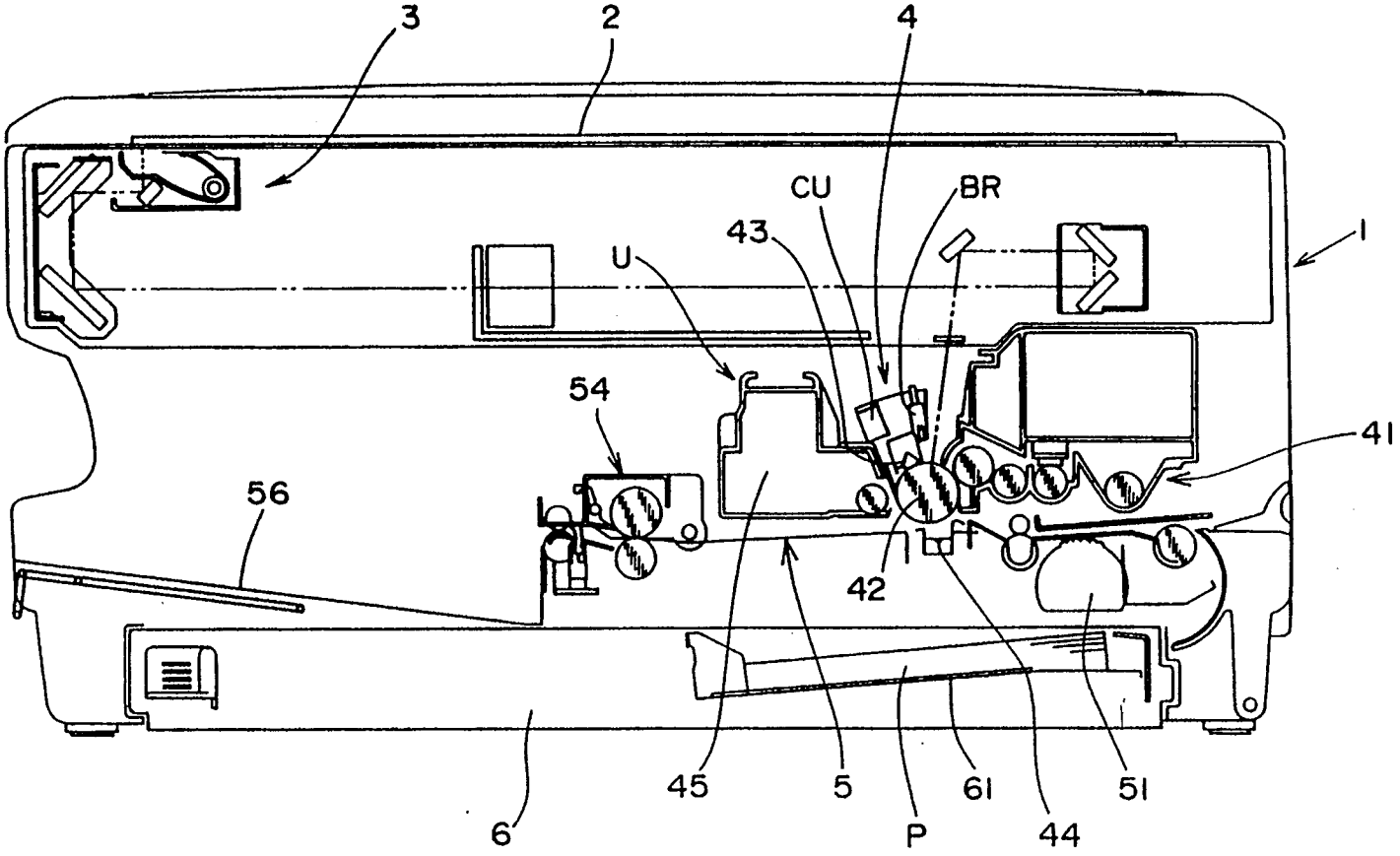
FIG. 1 is a schematic diagram showing the internal construction of a copying machine serving as an image forming apparatus employing the present embodiment.

Referring now to FIG. 1, in an image forming apparatus or a copying machine in an embodiment, the main body of the copying machine 1 comprises an optical system 3 for illuminating and scanning a document put on a transparent platen 2 to introduce reflected light from the document onto a photosensitive drum 42 or an image carrier; an image forming section 4, which includes the photosensitive drum 42, and develops an electrostatic latent image formed on the photosensitive drum 42 into a toner image by a developing device 41 and transfers the toner image on paper sheets; and a paper conveying section 5 for conveying a paper through the image forming section 4 to discharge the paper sheets onto a discharge tray 56. Paper conveying section 5 is provided with a fixing section 54 located at an intermediate portion of the paper conveying section 5 and a paper feed roller 51 being semicircular in cross section for pulling the paper sheets out of a paper feed tray 61 in a paper containing section 6 in the main body of the copying machine 1.

In the image forming section 4, a corona discharger 43, the developing device 41, a transferring corona discharger 44, and a cleaning device 45 are disposed in this order around the photosensitive drum 42. The optical system 3 of the image forming section 4 forms an electrostatic latent image from a document image on an outer peripheral surface of the photosensitive drum 42 uniformly charged by the corona discharger 43. The developing device 41 develops the electrostatic latent image into a toner image. The transferring corona discharger 44 transfers the toner image onto the paper sheets. The cleaning device 45 cleans the remaining toner on the photosensitive drum 42.

Figure 3:
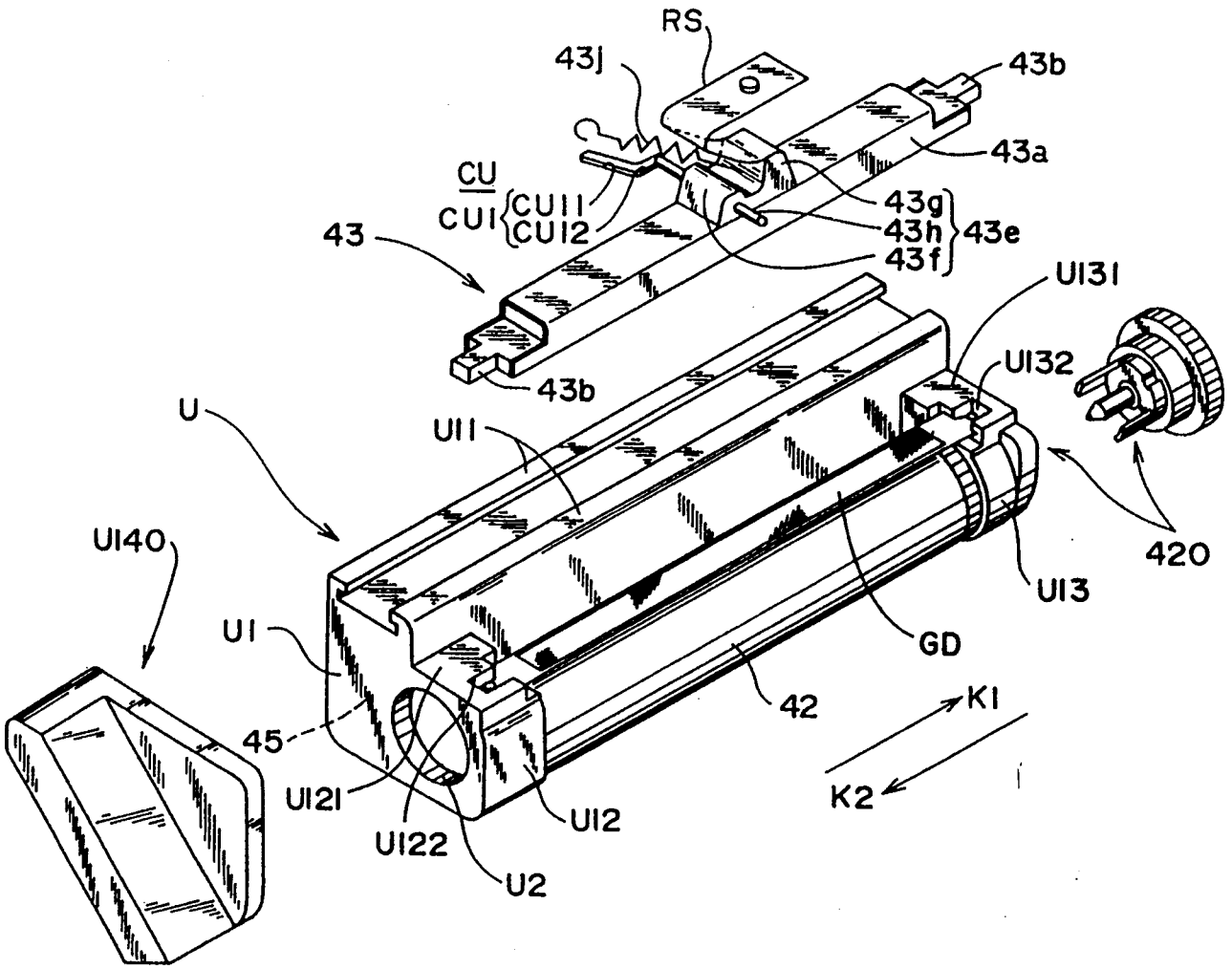
FIG. 3 is a schematic perspective view showing a principal part of the corona discharger displacing mechanism.

As shown in FIG. 3, the photosensitive drum 42 in the image forming section 4 is rotatably supported by a unit U so that torque is transmitted through an engaging clutch 420 from a driving mechanism in the main body of the copying machine 1.

This unit U comprises a housing U1 which integrally forms the external portion of the cleaning device 45. Integrally formed with an upper part of the cleaning device 45 in the housing U1 is a rail U11 which is connected to a guide (not shown) in the main body of the copying machine 1 so that the unit U can be inserted or extracted through an insertion port 100 (see FIG. 2) in the main body of the copying machine 1 (In FIG. 2, the directions of insertion and extraction are, respectively, indicated by arrows K1 and K2).

A pair of supporting portions U12 and U13 for supporting the photosensitive drum 42 extend from the housing U1. The supporting portions U12 and U13 are respectively provided with setting recesses U122 and U132, for setting the corona discharger 43 projected from a charging unit CU, that provide the precise positioning of the corona discharger 43 on the photosensitive drum 42. This positioning is firmly held by pressing the corona discharger 43 against an end surface of the setting recess U122 by the tensile force of a helical tension spring **43*j* or urging means as described later, and the urging force of a leaf spring RS for urging the corona discharger 43 toward the unit U against the tensile force. A well-known grid GD is stretched between the setting recesses U122 and U132, and is opposed to an image carrying surface of the photosensitive drum 42 with a predetermined opposed distance DS therebetween (see FIGS. 4 and 5**).

Figure 4:
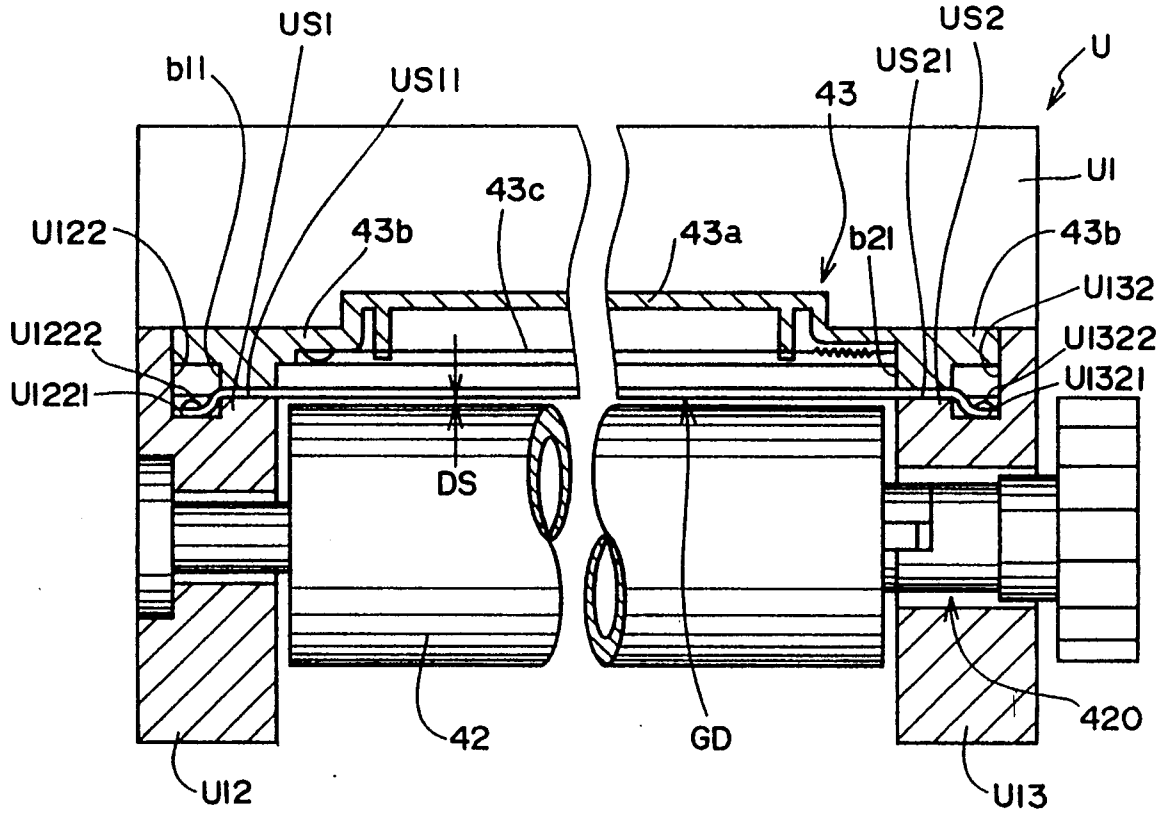
FIG. 4 is a schematic sectional view showing a principal part of a grid electrode positioning mechanism in one embodiment of the present invention.
Figure 5:
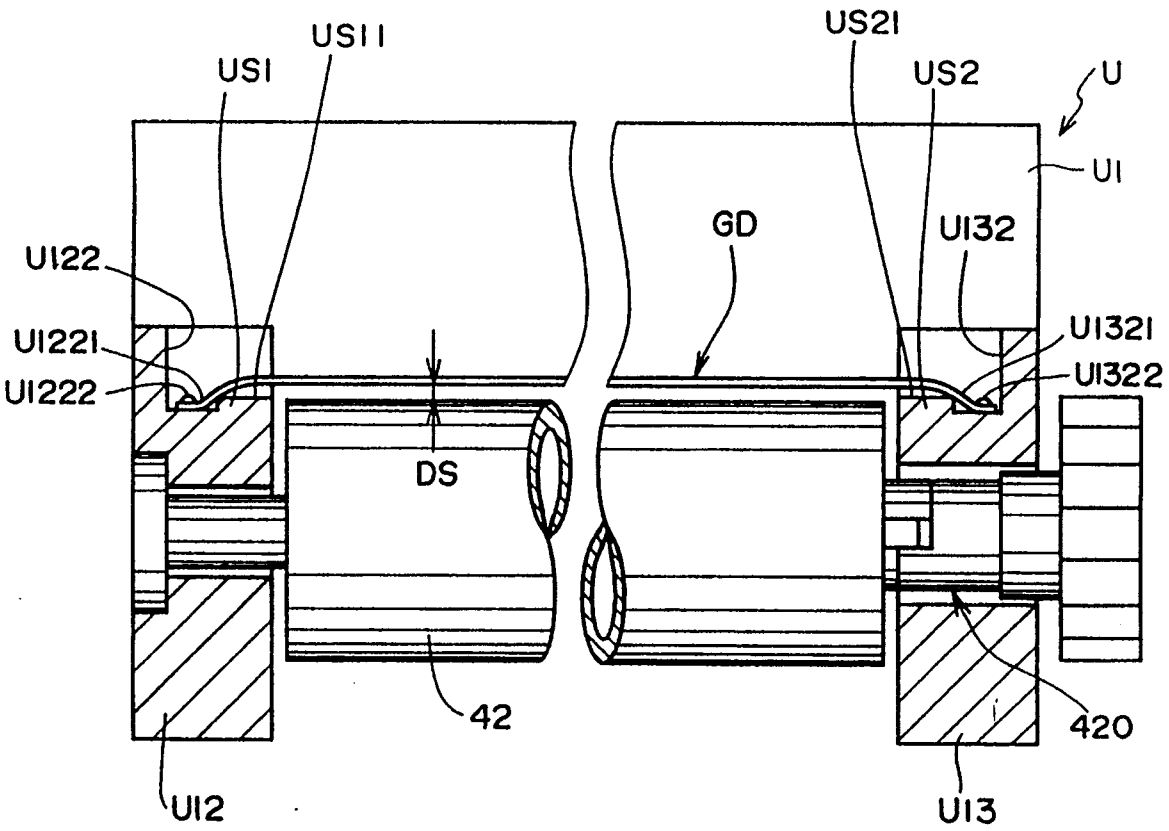
FIG. 5 is a schematic sectional view showing the principal part of the grid electrode positioning mechanism in the embodiment.
Figure 6:
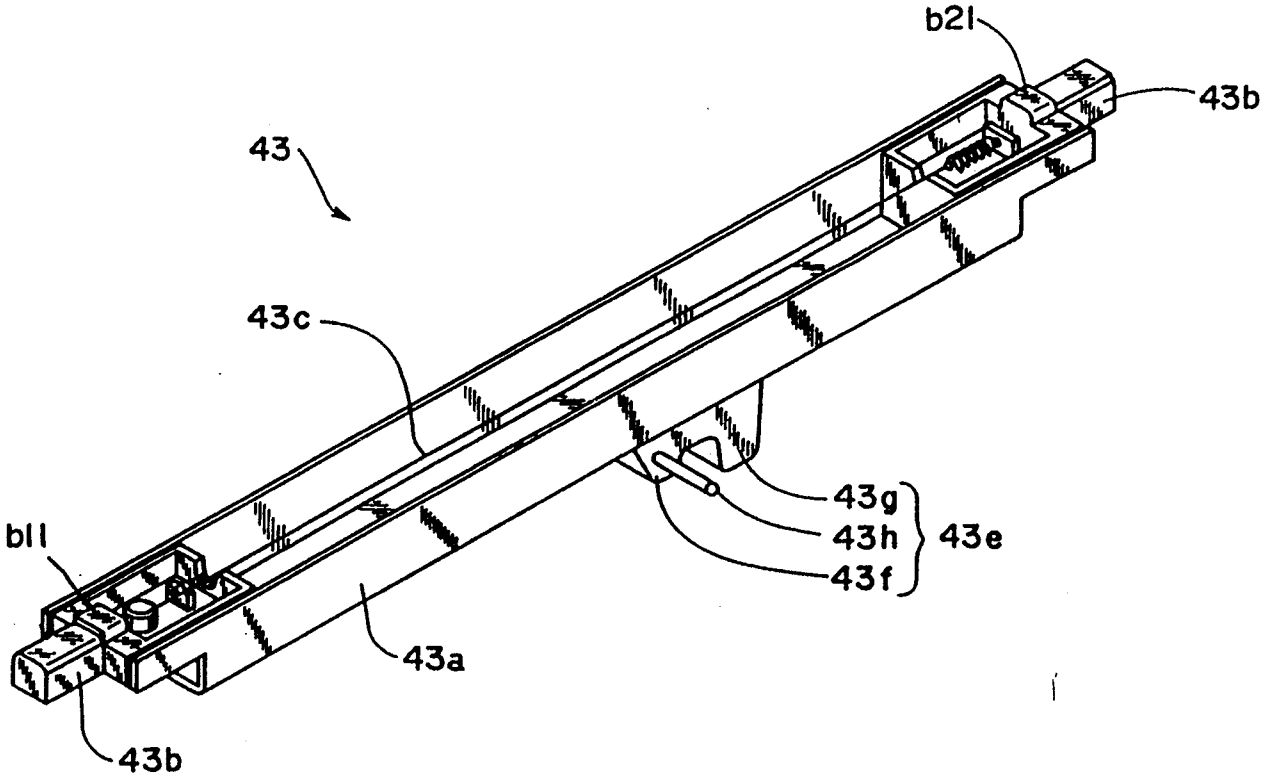
FIG. 6 is a schematic perspective view showing a principal part of the corona discharger.

Description is made in detail with reference to FIGS. 4 and 5. Dents U1221 and U1321 depress, respectively, toward the center in the radial direction of the photosensitive drum 42 and integral with the setting recesses U122 and U132. The dents U1221 and U1321 receive respectively both ends of the corresponding grid electrode GD on their bottom surfaces. The ends of the grid electrode GD are bolted to the bottom surfaces of the dents U1221 and U1321 using screws U1222 and U1322.

The shoulders of the dents U1221 and U1321 form respectively abutting portions US1 and US2 against which the vicinities of the ends of the grid electrode GD abut. The abutting portions US1 and US2 have respectively abutting surfaces US11 and US21 which are approximately parallel to the image carrying surface of the photosensitive drum 42. Vicinities of the ends of the grid electrode GD, which correspond to the abutting portions US1 and US2, abut on the abutting surfaces US11 and US21 in order to hold uniformly the tensile force exerted on the grid electrode GD thereby regulating the opposed distance DS between the grid electrode GD and the surface of the photosensitive drum 42 in co-operation with the screws U1222 and U1322.

Returning to FIG. 3, a unit cover U140 is mounted on an end surface on the leading side with respect to the direction of extraction K2 of the housing U1. Covered with the unit cover U140 is a hole formed in the housing U, for inserting a drum supporting member U2. Drum supporting member U2 also serves as a setting operating member for driving the corona discharger 43 as described later.

The main body of the copying machine 1 comprises a maintenance cover CV (see FIG. 7) for opening or closing the insertion port 100.

The charging unit CU is a supporting member made of a resin for supporting the corona discharger 43 along with a well-known blank lamp BR (only illustrated in FIG. 1), and is fixed to the main body of the copying machine 1.

The corona discharger 43 in the charging unit CU has a housing 43*a* which is in a channel like shape in cross section, a pair of guided members (operated members) 43*b* are integrally disposed at both ends of the housing 43*a* and fitted in the setting recesses U122 and U132 at the time of setting, and a discharge wire 43*c* is stretched between both the guided members 43*b*.

Provided to extend the guide member 43*b* are pressing portions b11 and b21 which are respectively opposed to the abutting surfaces US11 and US21 of the abutting portions US1 and US2 at the time of assembling as shown in FIGS. 4 and 5. The pressing portions b11 and b21 are for respectively pressing the vicinities of the ends of the grid electrode GD against the abutting surfaces US11 and US21.

Provided integrally on the rear surface of the housing 43*a* is a slider 43*e* which has continuously first and second projections 43*f* and 43*g* projecting upward and juxtaposing with each other in the directions of insertion and extraction of the unit U. First projection 43*f* is located at the trailing side with respect to the direction of insertion of the unit U. Provided with the first projection 43*f* is a pair of substantially axle-like engaging members 43*h* which extend in the width direction of the corona discharger 43.

As shown in FIGS. 2,3,7, and 8, the engaging members 43*h* are engaged with engaging slits CU1 which are formed in the sidewall of the charging unit CU. Each of these engaging slits CU1 has an inclined portion CU11 which is inclined upward on the leading side with respect to the direction of extraction K2 of the unit U and a parallel portion CU12 extending approximately parallel to the directions of insertion and extraction continuously from the leading side with respect to the direction of insertion K1 of the unit U in the inclined portion CU11. An end of the inclined portion CU11 and an end of the parallel portion CU12 respectively regulate a retreat position of the corona discharger 43 (a position shown in FIG. 2) and a set position of the corona discharger 43 (a position shown in FIG. 7). Although it is not specifically illustrated, the width of the parallel portion CU12 is set to a width larger by a predetermined dimension than the diameter of the engaging member 43*h* so as to ensure the amount of stroke for urging of the leaf spring RS.

Figure 2:
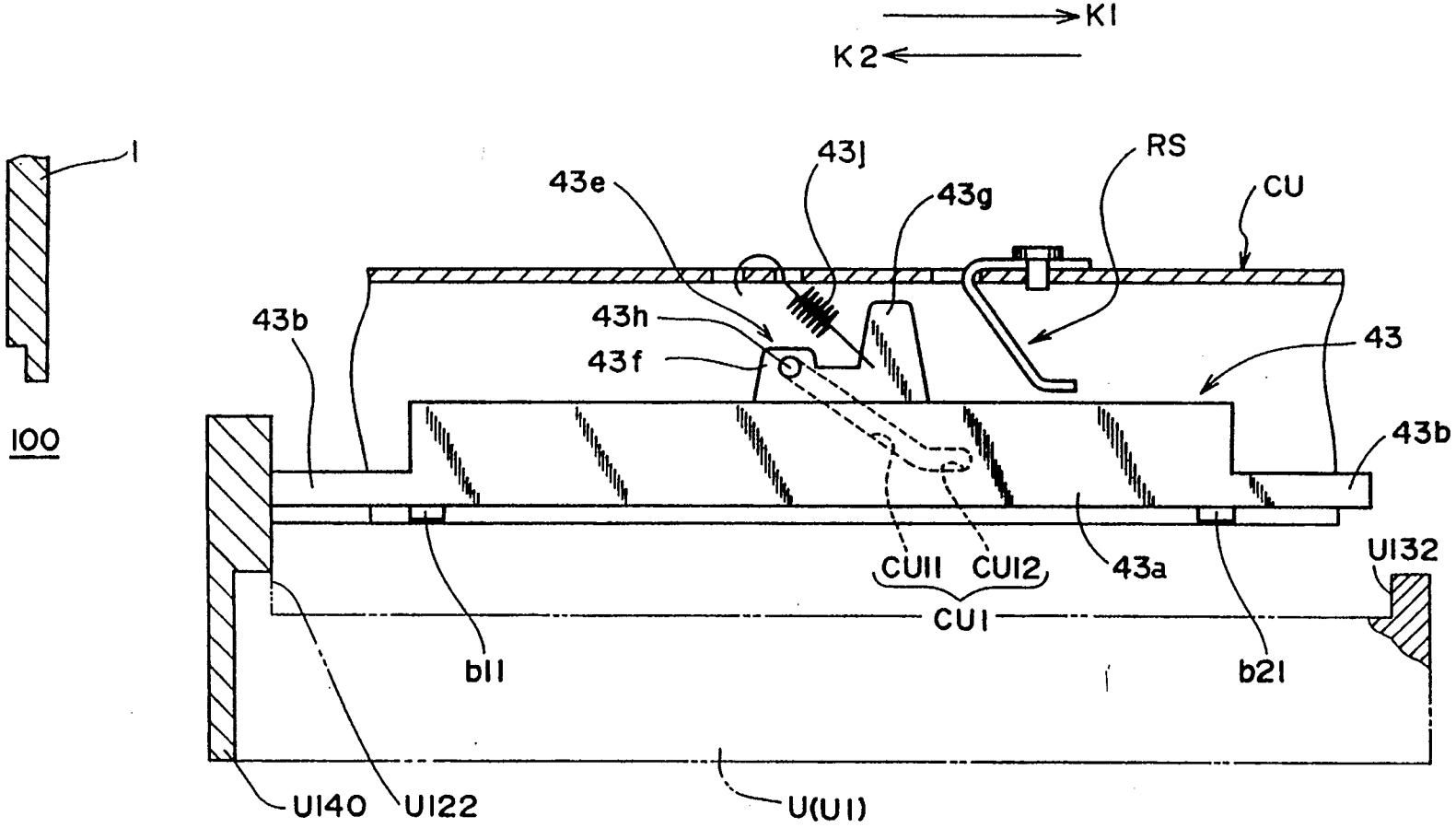
FIG. 2 is a schematic diagram showing a principal part of a corona discharger displacing mechanism in one embodiment of the present invention.

As clearly shown in FIG. 2, the helical tension spring 43*j* is stretched between a top plate portion of the charging unit CU and the slider 43*e* in the corona discharger 43, so that the corona discharger 43 is always urged toward the retreat position by the urging force of the helical tension spring 43*j*.

Furthermore, a base end of the leaf spring RS or holding means is bolted to the top plate portion of the charging unit CU, and a free end thereof urges the second projection 43*g* of the slider 43*e*, thereby to maintain the corona discharger 43 in the set position against the urging force of the helical tension spring 43*j*.

The helical tension spring 43*j* and the leaf spring RS constitute urging means for urging the corona discharger 43 toward the retreat position on the trailing side of the insertion of the unit U, while urging the same toward the set position on the leading side of the insertion thereof.

In the embodiment, the housing U1 in the unit U is provided with the setting recesses U122 and U132 so as to obtain accurate positioning of the corona discharger 43 on the unit U. Accordingly, an end surface of the setting recess U132 on the leading side with respect to the direction of insertion K1 also serves as a retreating operating member for releasing a state where the corona discharger 43 is held by the leaf spring RS at the time of extracting the unit U as described later.

The function of the corona discharger displacing mechanism according to the embodiment will be described with reference to FIGS. 2, 7 and 8.

Figure 7:
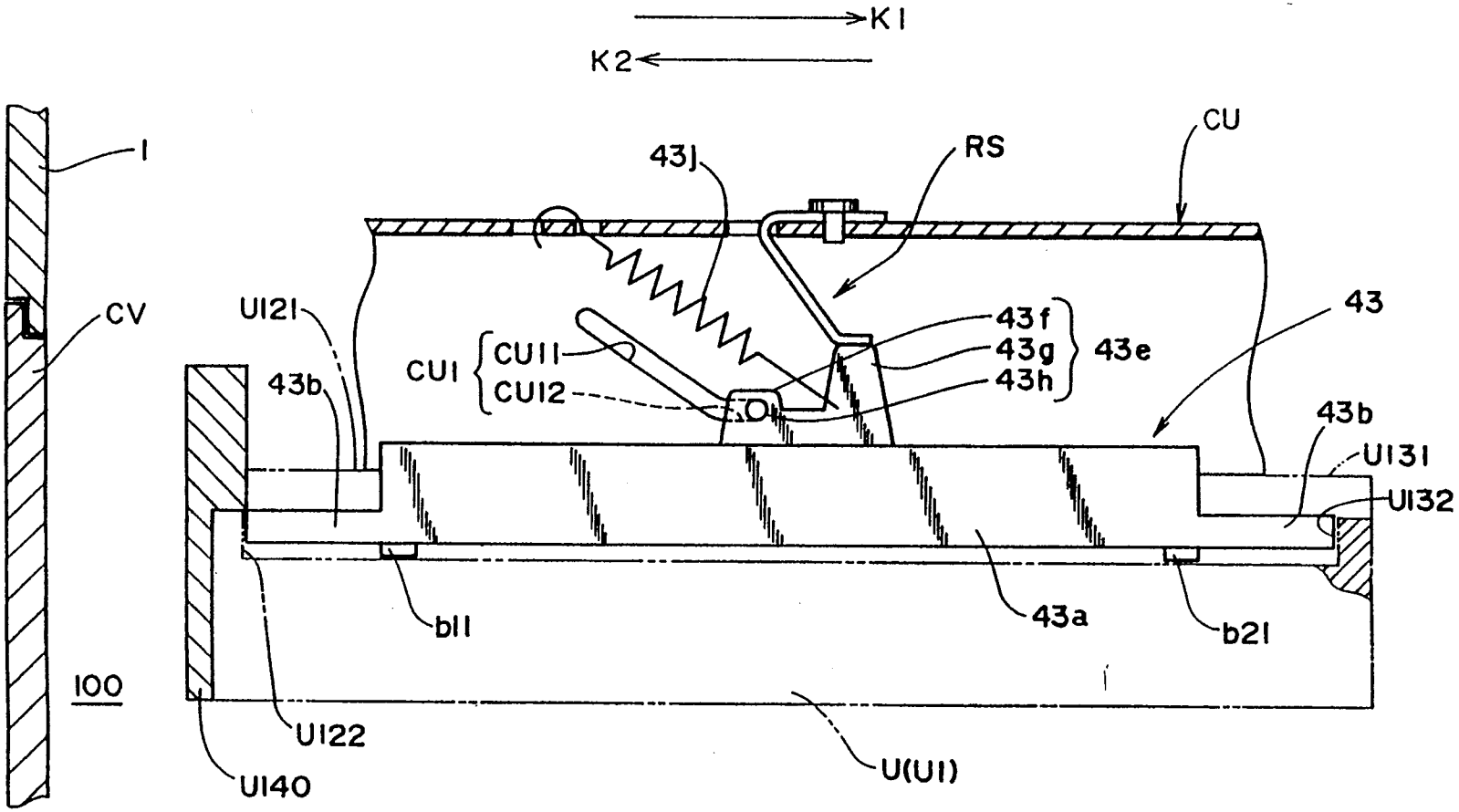
FIG. 7 is a schematic sectional view showing the function of the present invention.
Figure 8:
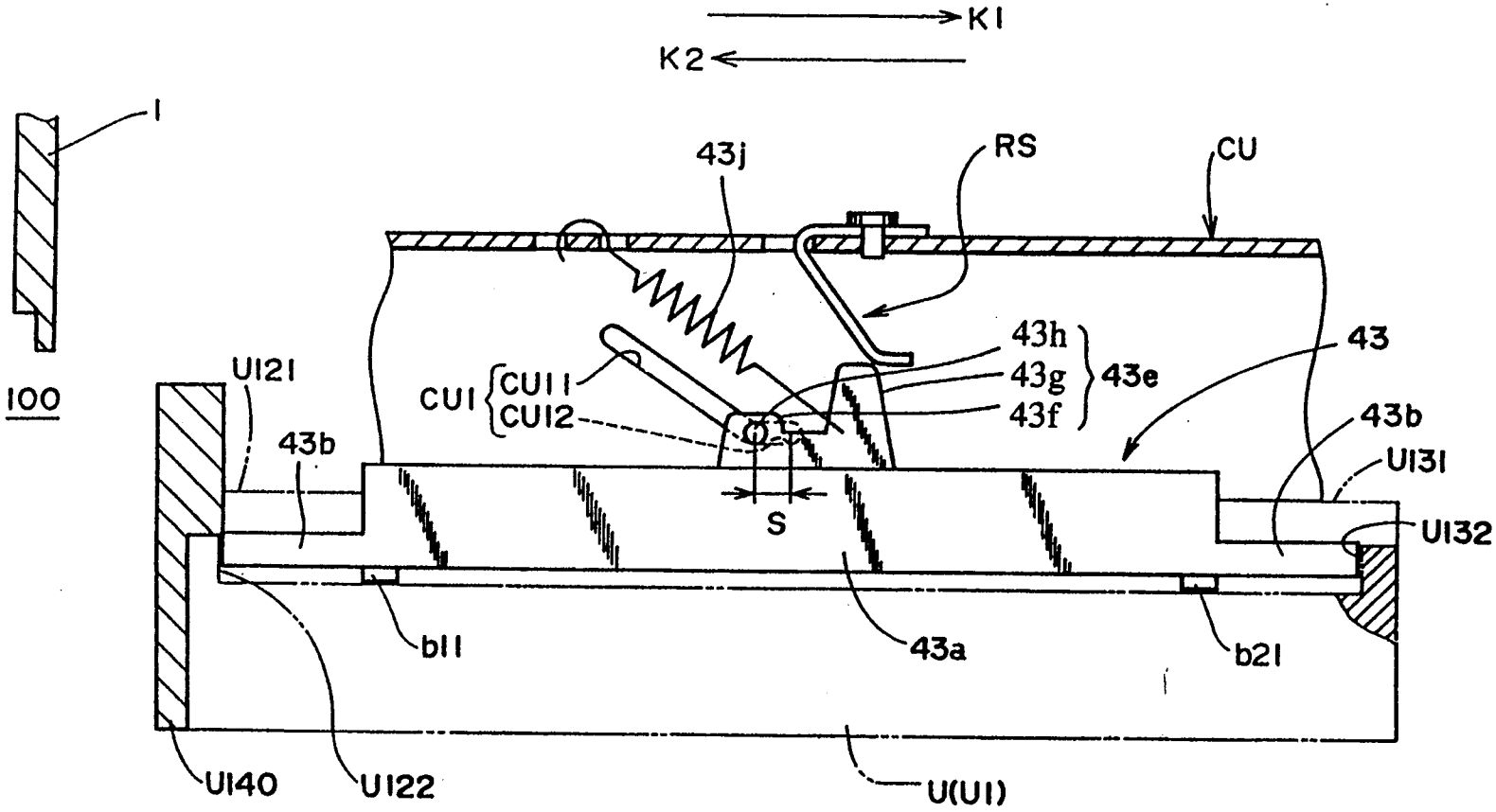
FIG. 8 is a schematic sectional view showing the function of the present invention.

By the construction, if the maintenance cover CV is opened when the corona discharger 43 is in the set position as shown in FIG. 7, and the unit U is extracted from the insertion port 100 by hand as shown in FIG. 8, the force in the direction of extraction K2 is transmitted to the guided members 43*b* of the corona discharger 43 through the end surface of the setting recess U132 in the unit U. Accordingly, the engaging member 43*h* of the slider 43*e* slides from a corresponding end of the parallel portion CU12 toward the inclined portion CU11 of the engaging slit CU1 by the stroke S of the parallel portion CU12. Consequently, the second projection 43*g* of the slider 43*e* is detached from the free end of the leaf spring RS, so that the slider 43*e* enters a free state. As a result, the leaf spring RS releases the corona discharger 43 held in the charging unit CU by the leaf spring RS, so that the engaging member 43*h* is displaced obliquely while it is guided by the inclined portion CU11 of the engaging slit CU1. Consequently, the corona discharger 43 is displaced to the retreat position by the urging force of the helical tension spring 43*j*, as shown in FIG. 2.

If a worker inserts the unit U from the state shown in FIG. 2 for the replacement, the unit cover U140 pushes end surfaces of the guided members 43*b* in the direction of insertion K1 in synchronism with the inserting operation, so that the slider 43*e* obliquely falls along the inclined portion CU11 of the engaging slit CU1 against the urging force of the helical tension spring 43*j*, leading to the end of the parallel portion CU12. As a result, the respective guided members 43*b* of the corona discharger 43 are guided by the corresponding setting recesses U122 and U132 of the unit U until the guided members 43*b* are fitted in the setting recesses U122 and U132, and the second projection 43*g* of the slider 43*e* is engaged with the free end of the leaf spring RS. Consequently, the corona discharger 43 is maintained in the set position shown in FIG. 7.

In this embodiment, if the unit U is inserted through the insertion port 100 when the corona discharger 43 is in the retreat position, the corona discharger 43 can be displaced to the set position shown in FIG. 7 by the unit cover U140 fixed to the unit U in synchronism with the inserting operation. This produces a significant effect of simplifying the operation and preventing the worker from forgetting to set the corona discharger 43.

On the other hand, in the embodiment, the corona discharger 43 can be displaced to the retreat position in synchronism with the extracting operation of the unit U, so that the user can perform maintenance work only by performing the extracting operation of the unit U. This also simplifies the work, thus reducing the burden to the user. Moreover, there is no likelihood that the corona discharger 43 will interfere with a member on the side of the unit U at the time of extracting the unit U.

Accordingly, the maintenance work of the unit U can be performed simply and reliably, thereby making it possible to construct an image forming apparatus most suitable for home or personal use.

Furthermore, in the embodiment, the engaging slit CU1 is provided with the parallel portion CU12 approximately parallel to the direction of replacement as means for guiding the corona discharger 43 to the set position, and the urging force of the leaf spring RS is exerted in a direction approximately orthogonal to the parallel portion CU12. Accordingly, the state where the corona discharger 43 is held can be maintained by exerting frictional resistance between the leaf spring RS and the slider 43*e* and between the engaging slit CU1 and the engaging member 43*h* by the stroke S of the parallel portion CU12, thereby making it possible to prevent the corona discharger 43 from carelessly retreating to the retreat position.

Additionally, in the corona discharger displacing mechanism according to the present embodiment, there are provided the helical tension spring 43*j* and the leaf spring RS for urging the corona discharger 43 toward the retreat position on the trailing side of the insertion of the unit U, while urging the same to the set position on the leading side of the insertion thereof. Therefore, the corona discharger 43 can stand still in the set position by the urging force of the leaf spring RS when the insertion of the unit U is terminated, while the corona discharger 43 can be moved to the retreat position by the urging force of the helical tension spring 43*j* at the time point where the extraction of the unit U is terminated.

If the corona discharger 43 retreats to some extent from the set position, therefore, the urging force for urging the corona discharger 43 toward the set position is released, and the corona discharger 43 can be urged toward the retreat position, thereby making it possible to reliably maintain a state where the corona discharger 43 retreats. In addition, if the corona discharger 43 progresses to some extent from the retreat position to the set position, the urging force for urging the corona discharger 43 toward the retreat position is released, and the corona discharger 43 can be urged toward the set position, thereby making it possible to reliably maintain a state where the corona discharger 43 is set. As a result, when the corona discharger 43 retreats, the state where the corona discharger 43 retreats can be promoted. On the other hand, when the corona discharger 43 is set, the unit U is prevented from being unlocked carelessly by the urging force of the urging means toward the set position, and the necessity of locking the unit U more firmly is eliminated.

Moreover, if the main body of the copying machine 1 is constructed as one of a clamshell type comprising an upper casing and a lower casing, and the unit U and the charging unit CU are mounted on the upper casing, the corona discharger 43 is caused to advance or retreat in synchronism with the insertion or extraction of the unit U, thereby making it possible to insert or extract the unit U irrespective of the opening or closing operation of the upper casing. As a result, the unit U can be kept horizontal by performing maintenance work of the unit U with the upper casing being closed.

Description is now made of the function in a grid electrode positioning mechanism according to the present embodiment.

As shown in FIG. 5, in the state where the corona discharger 43 retreats, the grid electrode GD is only mounted on the unit U, so that the grid electrode GD enters a state where it is raised from the abutting surfaces US11 and US21 of the pair of abutting portions US1 and US2. In the positioning mechanism according to the present embodiment, therefore, the vicinities of the ends of the grid electrode GD are respectively pressed against the abutting surfaces US11 and US21 of the corresponding abutting portions US1 and US2 by the pressing portions b11 and b21 when the corona discharger 43 is set in the set position, as shown in FIG. 4. Accordingly, the grid electrode GD is stretched between the abutting portions US1 and US2 and reliably positioned in a state where it is adapted to both the abutting portions US1 and US2.

As described in the foregoing, in the grid electrode positioning mechanism according to the present embodiment, the grid electrode GD can be stretched between the abutting portions US1 and US2 and reliably positioned in a state where it is adapted to both the abutting portions US1 and US2, thereby making it possible to precisely set the opposed distance DS between the grid electrode GD and the surface of the photosensitive drum 42 and consequently, exhibit high charging performance.

Figure 9:
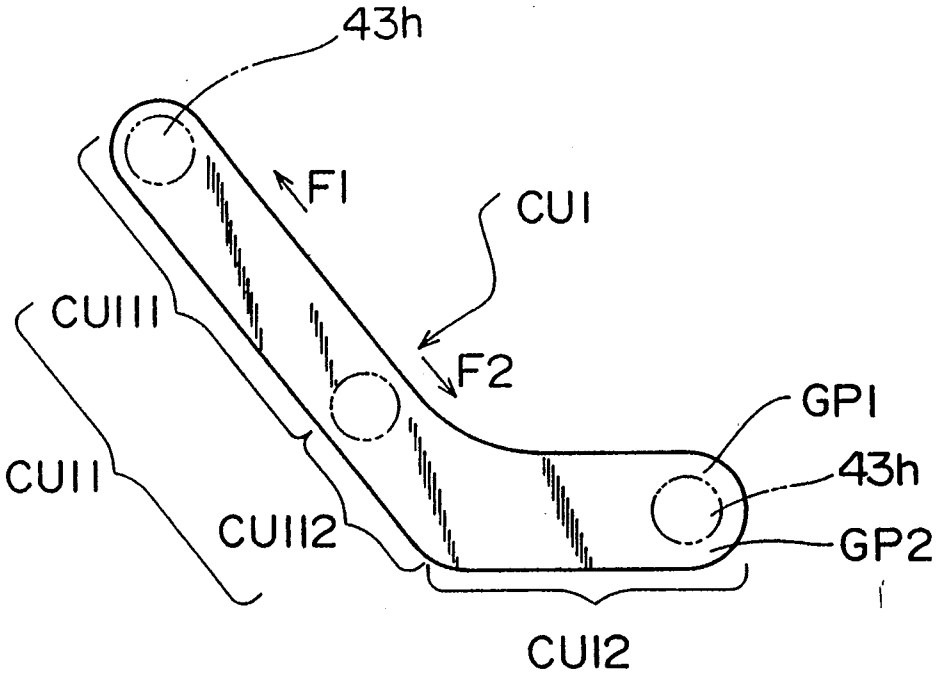
FIG. 9 is an enlarged view showing a principal part in another embodiment of the present invention.

Description is now made of another embodiment of the present invention with reference to FIG. 9.

The embodiment shown in FIG. 9 differs from the embodiment shown in FIG. 2 in that a stroke position where a second projection 43*g* of a slider 43*e* is attached to or detached from a leaf spring RS is altered.

More specifically, the second projection 43*g* is so adapted as to be attached to or detached from the leaf spring RS at the time point where an engaging member 43*h* of the slider 43*e* reaches an intermediate part of an inclined portion CU11 of an engaging slit CU1. A stroke portion in the inclined portion CU11 from a retreat position to a position for attachment or detachment is taken as CU111, a stroke portion from the position for attachment or detachment to the position where the inclined portion CU11 is joined to a parallel portion CU12 is taken as CU112, the urging force of a helical tension spring 43*j* is taken as F1, and the force for braking a corona discharger 43 by the urging force of the leaf spring RS is taken as F2. In this case, the urging force exerted on the corona discharger 43 is set as follows:

The urging force is only F1 in the stroke portion CU111, the urging force is F1>F2 in the stroke portion CU112, and the urging force is F1<F2 in the parallel portion CU12.

Thus, in a state where the unit U is completely pulled out, that is, in a case where the corona discharger 43 is in the retreat position, only the urging force F1 is exerted on the corona discharger 43. As a result, the corona discharger 43 stands still in the retreat position in a state where it is urged toward the retreat position by the helical tension spring 43*j*.

If the unit U is inserted to reach the stroke portion CU112, the leaf spring RS is engaged with the second projection 43*g* in the corona discharger 43. Whereas in the stroke portion CU112 F1>F2 are still set, so that the corona discharger 43 attempts to be returned toward the retreat position.

If the second projection 43*g* in the corona discharger 43 reaches the parallel portion CU12, F1<F2 holds. Thus, the braking force due to the spring force of the leaf spring RS makes the slider 43*h* stand still in the set position against the spring force of the helical tension spring 43*j*. As a result, the corona discharger 43 reliably stands still in the set position.

On the other hand, if the unit U is extracted to reach the stroke portion CU112, the corona discharger 43 is returned to the retreat position by the urging force of the helical tension spring 43*j*.

Also in the present embodiment, therefore, the same function and effect as those shown in FIG. 2 can be obtained.

The width of the parallel portion CU12 is set to a width larger by a predetermined dimension than the diameter of the engaging member 43*h*. Consequently, gaps GP1 and GP2 for ensuring the amount of stroke for urging of the leaf spring RS are formed.

The embodiments are mere illustrations of preferred embodiments of the present invention. It goes without saying that various design changes can be made within the range in which the gist of the present invention is not changed. For example, one end of the photosensitive drum 42 can be carried by the unit cover U140.

The embodiments are only concrete examples used for clarifying the technical contents of the present invention. Accordingly, the present invention should not be restricted to the concrete examples and interpreted in a restricted sense. Particularly, it should be noted that the corona discharger displacing mechanism according to the present invention can be applied to an image forming apparatus of a type other than the scorotron type, and the grid electrode positioning mechanism according to the present invention can be applied to an image forming apparatus of such a type that a corona discharger and a unit are not synchronized with each other.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A corona discharger displacing mechanism for an image forming apparatus, wherein the image forming apparatus includes a unit which forms at least a part of an image forming section for image formation which is replaceable through an insertion port in a main body of the image forming apparatus, and the image forming apparatus further includes a corona discharger set in a part of the unit, wherein the unit is provided for displacing the corona discharger between a retreat position where replacement of the unit is allowed and a set position where the unit is set, the corona discharger displacing mechanism comprising:

a setting operating member disposed on the unit for setting the corona discharger in the set position during an inserting operation of the unit;

wherein the unit includes a pair of supporting portions for carrying an image carrier in the image forming apparatus, and a unit cover for covering a hole formed in one supporting portion through which the image carrier may be replaced, wherein the unit cover serves as the setting operating member.

2. A corona discharger displacing mechanism according to claim 1, wherein the corona discharger includes a housing and operated members respectively formed on both ends of the housing and fitted in setting recesses formed in the supporting portions of the unit during the inserting operation.

3. A corona discharger displacing mechanism according to claim 1, wherein the supporting portions include setting recesses defined therein, wherein the setting recesses include a pair of dents for respectively containing both ends of a grid electrode.

4. A corona discharger displacing mechanism according to claim 1, wherein the corona discharger has a housing and a slider fixed to the housing, and the corona discharger is mounted on the image forming apparatus through the slider.

5. A corona discharger displacing mechanism for an image forming apparatus, wherein the image forming apparatus includes a unit which forms at least a part of an image forming section for image formation which is replaceable through an insertion port in a main body of the image forming apparatus,.and the image forming apparatus further includes a corona discharger set in a part of the unit, wherein the unit is provided for displacing the corona discharger between a retreat position where replacement of the unit is allowed and a set position where the unit is set, the corona discharger displacing mechanism comprising:

a retreating operating member disposed on the unit for retreating the corona discharger to the retreat position during an extracting operation of the unit;

wherein the unit includes a pair of supporting portions for carrying an image carrier in the image forming apparatus, wherein the supporting portions respectively each include a setting recess for setting the corona discharger, wherein the setting recesses respectively have end surfaces which serve as the retreating operating member.

6. A corona discharger displacing mechanism according to claim 5, wherein the corona discharger includes a housing and operated members respectively formed on both ends of the housing and fitted in the setting recesses in the set position.

7. A corona discharger displacing mechanism according to claim 5, wherein the setting recesses include a pair of dents for respectively containing both ends of a grid electrode.

8. A corona discharger displacing mechanism according to claim 5, wherein the corona discharger has a housing and a slider fixed to the housing, and the corona discharger is mounted on the image forming apparatus through the slider.

9. A corona discharger displacing mechanism for an image forming apparatus, wherein the image forming apparatus includes a unit which forms at least a part of an image forming section for image formation which is replaceable through an insertion port in a main body of the image forming apparatus, and the image forming apparatus further includes a corona discharger set in a part of the unit, wherein the unit is provided for displacing the corona discharge between a retreat position where replacement of the unit is allowed and a set position where the unit is set, the corona discharger displacing mechanism comprising:

a setting operating member disposed on the unit for setting the corona discharger in the set position during an inserting operation of the unit;

a retreating operating member disposed on the unit for retreating the corona discharger to the retreat position during an extracting operation of the unit; and urging means for urging the corona discharger toward the retreat position at a time of initiating the inserting operation, the urging means further urging the corona discharger toward the set position when the inserting operation is completed;

wherein the unit includes a pair of supporting portions for carrying an image carrier in the image forming apparatus, and a unit cover for covering a hole formed in one supporting portion through which the image carrier may be replaced, wherein each of the supporting portions respectively provides a setting recess for setting the corona discharger, wherein the unit cover serves as the setting operating member, and wherein the setting recesses respectively have end surfaces which serve as the retreating operating member.

10. A corona discharger displacing mechanism according to claim 9, wherein the corona discharger has a housing and a slider fixed to the housing, and the corona discharger is mounted on the image forming apparatus through the slider, and the urging means urges the corona discharger through the slider.

11. A corona discharger displacing mechanism according to claim 10, wherein the image forming apparatus has a charging unit carrying the corona discharger, the slider has an engaging member which is engaged with an engaging slit formed in the corona discharger, and the engaging slit has an inclined portion which is inclined upward on a leading side with respect to a direction of extraction of the unit, and the engaging slit further including a parallel portion extending approximately parallel to the direction of extraction of the unit continuously from the leading side with respect to a direction of insertion of the unit.

12. A corona discharger displacing mechanism according to claim 11, wherein the urging means has a first urging member for urging the slider so that the corona discharger is moved to the retreat position and a second urging member for urging the corona discharger through the slider, wherein the second urging member is adapted to contact the slider when the engaging member reaches an intermediate part of the inclined portion, and the first and second urging members being provided such that an urging force of the first urging member is stronger than an urging force of the second urging member when the engaging member is in the inclined portion, and the urging force of the second urging member is stronger than the urging force of the first urging member when the engaging member is in the parallel portion.

13. A corona discharger displacing mechanism according to claim 12, wherein a gap for ensuring a stroke for urging of the second urging member is formed between the parallel portion of the engaging slit and the engaging member.

14. A corona discharger displacing mechanism according to claim 9, wherein the corona discharger includes a housing and operated members respectively formed on both ends of the housing and fitted in the setting recesses during the inserting operation.

15. A corona discharger displacing mechanism according to claim 9, wherein the setting recesses include a pair of dents for respectively containing both ends of a grid electrode.

16. A corona discharger displacing mechanism according to claim 9, wherein the corona discharger has a housing and a slider fixed to the housing, and the corona discharger is mounted on the image forming apparatus through the slider.

17. A grid electrode positioning mechanism for an image forming apparatus, wherein the image forming apparatus includes a unit which supports an image carrier rotatably, wherein the unit is removable through an insertion port provided in a main body of the image forming apparatus, wherein a grid electrode is mounted on the unit so as to stretch above a surface of the image carrier with a predetermined space therebetween, and a corona discharger capable of being displaced, wherein the corona discharger is opposed to the surface of the image carrier through the grid electrode, the grid electrode positioning mechanism comprising:

fixing members for fixing both ends of the grid electrode in predetermined parts of the unit;

a pair of abutting portions provided on the unit so as to apply a tensile force to the grid electrode in co-operation with the fixing members and abutting against both ends of the grid electrode while the space between the grid electrode and the image carrier is regulated; and a pair of pressing portions provided on the corona discharger for pressing the grid electrode against the corresponding abutting portions such that the grid electrode is pinched between the abutting portions and the pressing portions so as to accurately position the grid electrode with respect to the surface of the image carrier.

18. A grid electrode positioning mechanism according to claim 17, wherein the unit includes a pair of supporting portions for carrying the image carrier in the image forming apparatus, the supporting portions respectively include setting recesses for setting the corona discharger, the corona discharger includes a housing and guided members respectively formed in both ends of the housing, wherein the corona discharger is fitted in the setting recesses during an inserting operation, and the pressing portions are integrally formed on the guided members.

19. A grid electrode positioning mechanism according to claim 18, wherein the setting recesses respectively have dents constituting the abutting portions.

20. A grid electrode positioning mechanism according to claim 18, wherein the corona discharger is movable during the inserting operation and during a retreating operation in synchronism with inserting or extracting the unit by a displacing mechanism.

21. A grid electrode positioning mechanism according to claim 20, wherein the displacing mechanism includes a setting operating member disposed on the unit for setting the corona discharger in a set position while inserting the unit.

22. A grid electrode positioning mechanism according to claim 20, wherein the displacing mechanism includes a retreating operating member disposed on the unit for retreating the corona discharger to a retreat position while extracting the unit.

23. A grid electrode positioning mechanism according to claim 20, wherein the displacing mechanism includes:

a setting operating member disposed on the unit for setting the corona discharger in a set position while inserting the unit, a retreating operating member disposed on the unit for retreating the corona discharger to a retreat position while extracting the unit, and urging means for urging the corona discharger toward the retreat position at a time of the inserting operation and toward the set position at a time when the inserting operation is completed.

* * * * *